US009976294B1

(12) United States Patent
Flury

(10) Patent No.: US 9,976,294 B1
(45) Date of Patent: May 22, 2018

(54) DUAL ACTION RETRACTABLE SCREEN TO BE MOUNTED TO A CURB INLET

(71) Applicant: Terry A Flury, Long Beach, CA (US)

(72) Inventor: Terry A Flury, Long Beach, CA (US)

( * ) Notice: Subject to any disclaimer, the term of this patent is extended or adjusted under 35 U.S.C. 154(b) by 0 days. days.

(21) Appl. No.: 15/834,281

(22) Filed: Dec. 7, 2017

Related U.S. Application Data

(60) Provisional application No. 62/572,463, filed on Oct. 14, 2017.

(51) Int. Cl.
*E03F 5/06* (2006.01)
*E03F 5/04* (2006.01)
*E03F 5/046* (2006.01)

(52) U.S. Cl.
CPC ..... *E03F 5/0411* (2013.01); *E03F 5/0404* (2013.01); *E03F 5/046* (2013.01); *E03F 5/06* (2013.01); *E03F 2005/061* (2013.01)

(58) Field of Classification Search
CPC . E03F 5/0404; E03F 5/046; E03F 5/06; E03F 5/14; E03F 2005/061; E02B 8/023
USPC ..... 210/131, 156, 162, 163, 170.03, 747.3
See application file for complete search history.

(56) References Cited

U.S. PATENT DOCUMENTS 1,245,903 A * 11/1917 Gross ..... E03F 5/046 210/163
6,015,489 A * 1/2000 Allen ..... E03F 5/046 210/163
6,217,756 B1 * 4/2001 Martinez ..... E03F 5/0404 210/163
6,869,523 B2 3/2005 Martinez
6,972,088 B2 12/2005 Yehuda
7,234,894 B1 6/2007 Flury
7,238,279 B2 7/2007 Saurenman
7,467,911 B2 12/2008 Flury
7,491,338 B2 2/2009 Nino
7,549,820 B1 * 6/2009 Happel ..... E03F 5/0404 210/163
7,951,291 B2 5/2011 Nino
8,017,006 B2 9/2011 Lopez
8,277,645 B2 10/2012 Jarvis
8,535,523 B2 9/2013 Friezner
8,945,375 B2 2/2015 Frienzner
9,057,189 B2 6/2015 Flury
2004/0069697 A1 4/2004 Martinez
2004/0173513 A1 9/2004 Nino
(Continued)

*Primary Examiner* — Christopher Upton
(74) *Attorney, Agent, or Firm* — Manuel de la Cerra

(57) ABSTRACT

A dual action retractable screen includes a first screen portion with a first screen portion perforated surface connected to the hinge mount via a horizontal hinge, which allows the first screen portion to rotate within a substantially horizontal plane. The screen also has a second screen portion with a second screen portion perforated surface and a latch pin. A vertical hinge connects the first screen portion to the second screen portion and allows the second screen portion to rotate within a substantially vertical plane. The screen also includes a latch mount that connects to the curb inlet and has a latch saddle that receives the latch pin. The screen operates in two modes: (1) a closed mode where the latch pin is disposed of in the latch saddle, inhibiting rotation about the horizontal hinge; and (2) an open mode where the latch pin is dislodged from the latch saddle, permitting rotation about the horizontal hinge and about the vertical hinge.

20 Claims, 14 Drawing Sheets

(56) References Cited

U.S. PATENT DOCUMENTS

| | | | | |
|---|---|---|---|---|
| 2008/0014021 | A1 | 1/2008 | Flury | |
| 2008/0226390 | A1 | 9/2008 | Nino | |
| 2009/0236293 | A1 | 9/2009 | Alvarado | |
| 2010/0147752 | A1 | 6/2010 | Jarvis | |
| 2012/0103883 | A1 | 5/2012 | Friezner | |
| 2014/0041744 | A1 | 2/2014 | Friezner | |
| 2014/0097133 | A1 | 4/2014 | Flury | |
| 2014/0262996 | A1 | 9/2014 | Alvarado | |
| 2015/0053598 | A1 | 2/2015 | Friezner | |
| 2015/0101969 | A1* | 4/2015 | Jarvis ..... | E03F 5/046 210/131 |

* cited by examiner

DUAL ACTION RETRACTABLE SCREEN TO BE MOUNTED TO A CURB INLET

RELATED APPLICATIONS

The present application claims priority to U.S. Provisional Patent Application No. 62/572,463 filed on Oct. 14, 2017, all of the contents of which are incorporated herein by reference including all tables, figures and claims.

TECHNICAL FIELD

The present invention relates to generally to curb inlets leading to storm drain catch basins, and more specifically to retractable screens for such catch basins.

BACKGROUND

Typical curbed storm drain catch basins are designed as a primary entry points for urban water runoff. The curb openings provide nuisance water, low flow storm water, and high flow storm water into the catch basin, as well as trash and/or debris that emanates from the streets and curbsides. Trash and/or debris such as bottles, cans, plastic wrappers, leaves, grass cuttings, sediments, manure, hydrocarbons, and other pollutants frequently find their way into these catch basins and may travel through storm drain outlet pipes and into rivers, lakes, oceans, and other bodies of water.

A vast majority of screened covers that have been inserted into curb opening catch basins stay closed during the dry season and swing open through mechanical trip devices when the storm water reaches a predetermined curb height. During heavy rainfall events, due to storms or water main pipeline breakage, it is imperative that, when water flows from the streets into the curb openings containing these retractable screens, the screens open up significantly in order to prevent street flooding.

Street sweeping trucks clean up accumulated debris that is collected in front of these closed screens during periodic maintenance/service schedules. Large pieces of trash can be pushed into the curb inlet openings inadvertently by the street sweeping trucks; rotating brushes on the sweepers designed to collect the debris, when approaching a curb inlet, can inadvertently push the larger trash/debris inside the basin. Many retractable screened devices that have been designed to block trash/debris from entering the curb inlet basins in the dry seasons open vertically in the curb inlet space of the catch basin during high storm water flow.

During large "first-flush" storm water events, large accumulated trash emanating from the curb-gutter areas of a typical street can block the opening area of a vertically opening storm drain screen system, thus causing street flooding and possibly causing property damage. There are many different curb inlet style catch basin types within the United States of America, as well as across the world. Some include severe, top angled, and throated curb inlets. Typically, vertically opening screened covers inserted into these types of curb inlets cannot properly function as designed, due to the severe throat angle, as well as due to the short opening distance from the curb face to the back wall of the curb inlet area of the storm drain catch basin. Also, some curb inlets can only be 2½" to 4" in height, in which case vertical-opening-only type screen devices installed into these narrow inlets cannot properly function during a large storm water event. Vertical-screen-only locking and unlocking providers include, for example, US Publication 2010/0147752 to Jarvis, U.S. Pat. No. 6,972,088 to Yehuda, U.S. Pat. No. 2014/0262996 to Alvarado, U.S. Pat. No. 7,238,279 to Saurenman, U.S. Publication No. 2004/0173513 to Nino, U.S. Publication No. 2004/0069697 to Martinez, and now U.S. Pat. No. 7,234,894 to Flury.

Some disadvantages of these systems include the susceptibility to being fouled with trash/debris often, due to these systems' inability to open vertically enough in the curb inlet throat area of a stormwater catch basin. Additionally, another known screen system, such as that disclosed in, for example, U.S. Pat. No. 2010/0147752 to Jarvis, utilized elongated openings or slots, which are easily fouled with small trash, debris such that the screens will malfunction and not open.

Because of these shortcomings, there is a need in the art for a combined, horizontal and vertical retractable screen that cannot be fouled with trash/debris to prevent its mechanisms from opening during "first-flush" storm water events. Furthermore, a retractable screen that can open both horizontally and vertically to a higher degree in the curb inlet space prevents the clogging or entanglement of trash/debris within any curb inlet throat area.

Finally, there is also a need for a retractable screen that is capable of being manually opened from the street side and locked in the open position before or during a large storm event. The retractable screen should remain open until manually released, also from the street side. The ability to manually open and lock the retractable screen provides added flexibility to areas that may experience trouble draining.

SUMMARY

The present invention provides an elegant solution to the needs described above and offers numerous additional benefits and advantages, as will be apparent to persons of skill in the art. A dual action retractable screen is disclosed. The screen includes a hinge mount that connects to the inlet. The screen also includes a first screen portion with a first screen portion perforated surface connected to the hinge mount via a horizontal hinge, which allows the first screen portion to rotate within a substantially horizontal plane. The screen also has a second screen portion with a second screen portion perforated surface and a latch pin. A vertical hinge connects the first screen portion to the second screen portion and allows the second screen portion to rotate within a substantially vertical plane. The screen also includes a latch mount that connects to the curb inlet, the latch mount has a latch saddle that receives the latch pin. The screen operates in two modes: (1) a closed mode where the latch pin is disposed of in the latch saddle, inhibiting rotation about the horizontal hinge; and (2) an open mode where the latch pin is dislodged from the latch saddle, permitting rotation about the horizontal hinge and about the vertical hinge.

The screen may transition from the closed mode to the open mode when the second screen portion rotates about the vertical hinge, causing the latch pin to move away from the latch saddle. The second portion may receive a force from a stream of water entering the curb inlet, and upon receiving the water force the second screen portion rotates about the vertical hinge, and if the water force is large enough, causing the latch pin to move away from the latch saddle, has a sufficient distance to transition the screen from the closed to open mode. A water catch plate may receive the water force.

The amount of water force necessary to open the screen may be adjusted. To transition from the closed to open mode, a minimum movement of the latch pin may be necessary before the latch pin dislodges from the latch saddle. This minimum movement may be varied. For example, the latch saddle position may be adjustable and the minimum movement is varied by changing the position of the latch saddle. As another non-limiting example, a latch pin rest may be used and the latch pin rest position may be adjustable. The minimum movement is varied by changing the position of the latch pin rest. The adjustment of the minimum movement can be varied from the street side of the curb inlet. The second portion may be constructed to receive the water force, and, upon receiving the water force, the latch pin moves away from the latch saddle. The amount of latch pin movement is based on the magnitude of the water force. Thus, varying the minimum movement varies the magnitude of water force necessary to transition the screen from the closed mode to the open mode.

To accommodate manually locking the screen in the open position, possibly in anticipation of a high flood event, the screen may include a locking pin hole and a locking pin. The locking pin is constructed to engage the locking pin hole and when so engaged inhibits rotation about the horizontal hinge. Placement of the locking pin and the locking pin hole can maintain the screen locked in the open position. The locking pin may move vertically to engage the locking pin, and the locking pin may be accessible from the street side of the curb inlet, thus allowing engagement of the locking pin from the street side of the curb inlet.

Additional feature include the following. The horizontal hinge may include a horizontal hinge spring that biases the position of the first portion. Similarly, the vertical hinge may have a vertical hinge spring that biases the position of the second portion. For additional safety, the screen may include a child safety bar that may extend substantially the entire length of the curb inlet. The second portion of the screen may be at least twice as long as the first portion. The hinge mount may attach to the curb inlet via a hinge mount bracket. Likewise, the latch mount may attach to the curb inlet via a latch mount bracket. The horizontal hinge allows a rotation of the first portion of at least 5 degrees, while the vertical hinge allows a rotation of the second portion of at least 5 degrees.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

DETAILED DESCRIPTION

Figure 1:
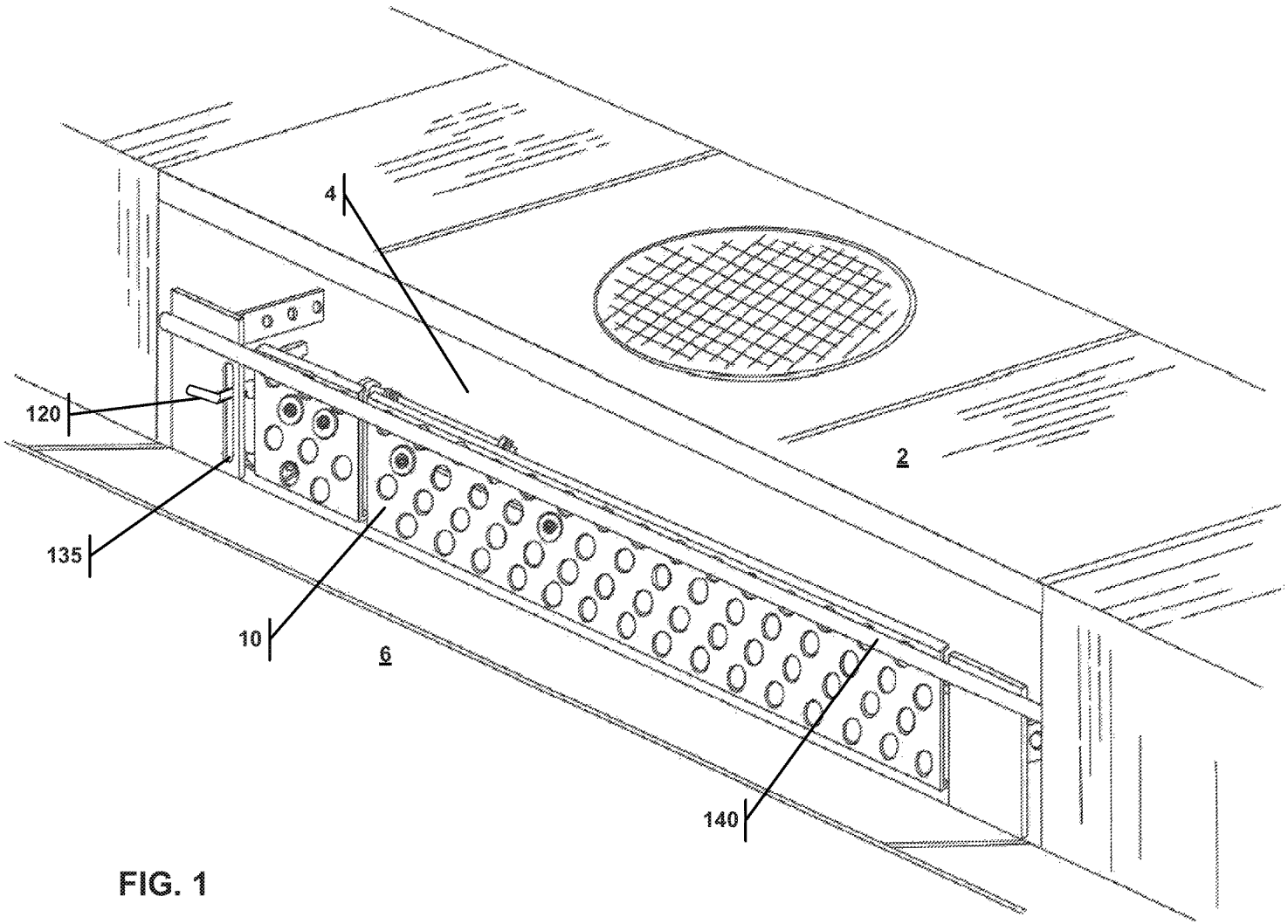
FIG. 1 is a front perspective view of a dual action retractable screen installed across a typical storm drain curb inlet in the closed mode.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Furthermore, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with FIGS. 1-13 and is provided for ease of reference, where like reference numerals designate corresponding features throughout the specification and figures:

Curb 2
Curb Wall 3
Curb Inlet 4
Street 6
Dual Action Retractable Screen 10
Horizontal Rotation 12
Vertical Rotation 14
First Screen Portion 15
First Screen Portion Perforated Surface 20
Second Screen Portion 25
Second Screen Portion Perforated Surface 30
Hinge Mount 35
Hinge Mount Bracket 40
Latch Mount 45
Latch Mount Bracket 50
Horizontal (First) Hinge 55
Horizontal Hinge Bracket 60
Horizontal Hinge Pin 65
Horizontal Hinge Spring Bolt 67
Horizontal Hinge Spring 70
Horizontal Hinge Spring Force Adjustment Slots 72
Vertical (Second) Hinge 75
Vertical Hinge Bracket 80
Vertical Hinge Pin 85
Vertical Hinge Spring 90
Water Catch Plate 95
Water Force 97
Water Flow 98
Latch Pin 100
Latch Pin Disengagement Motion 102
Latch Pin Minimum Movement 103
Latch Saddle Bracket Movement 104
Latch Saddle 105
Latch Saddle Adjustment Fasteners 110
Latch Saddle Bracket 112
Latch Saddle Bracket (second embodiment) 112*a*
Latch Saddle Bracket Slot 113
Latch Saddle Bracket Fastener 114
Latch Pin Rest 115
Latch Pin Rest Adjustment Direction 117
Locking Pin 120
Locking Pin Sleeve 122
Locking Pin Hole 125
Second Locking Pin Hole 125*a*
Locking Pin Hole Bracket 130
Locking Pin Channel 135
Locking Pin Movement 137
Child Safety Bar 140

Disclosed in FIGS. 1-13 is a retractable screen for use in a curb inlet. The screen is dual action in that it can open about two axes that are orthogonal to each other. This would in many installations result in a horizontal and vertical opening, which results in being less prone to fouling with trash/debris and can more reliably open during "first-flush" storm water events. Because it is dual action it can open to a much larger degree, mitigating clogging or entanglement of trash/debris within any curb inlet. The screen can be manually opened from the street side and locked in the open position before or during a large storm event. Once the storm even subsides, the screen locked position can be manually released, also from the street side.

FIG. 1 illustrates a dual action retractable screen 10 installed across a typical storm drain curb inlet 4 located adjacent to a street 6. The screen 10 is shown in the closed mode. This mode would occur when there is no water flowing into the inlet 4, or when the flow of water is minor and insufficient to transition the screen into the open mode.

Figure 2:
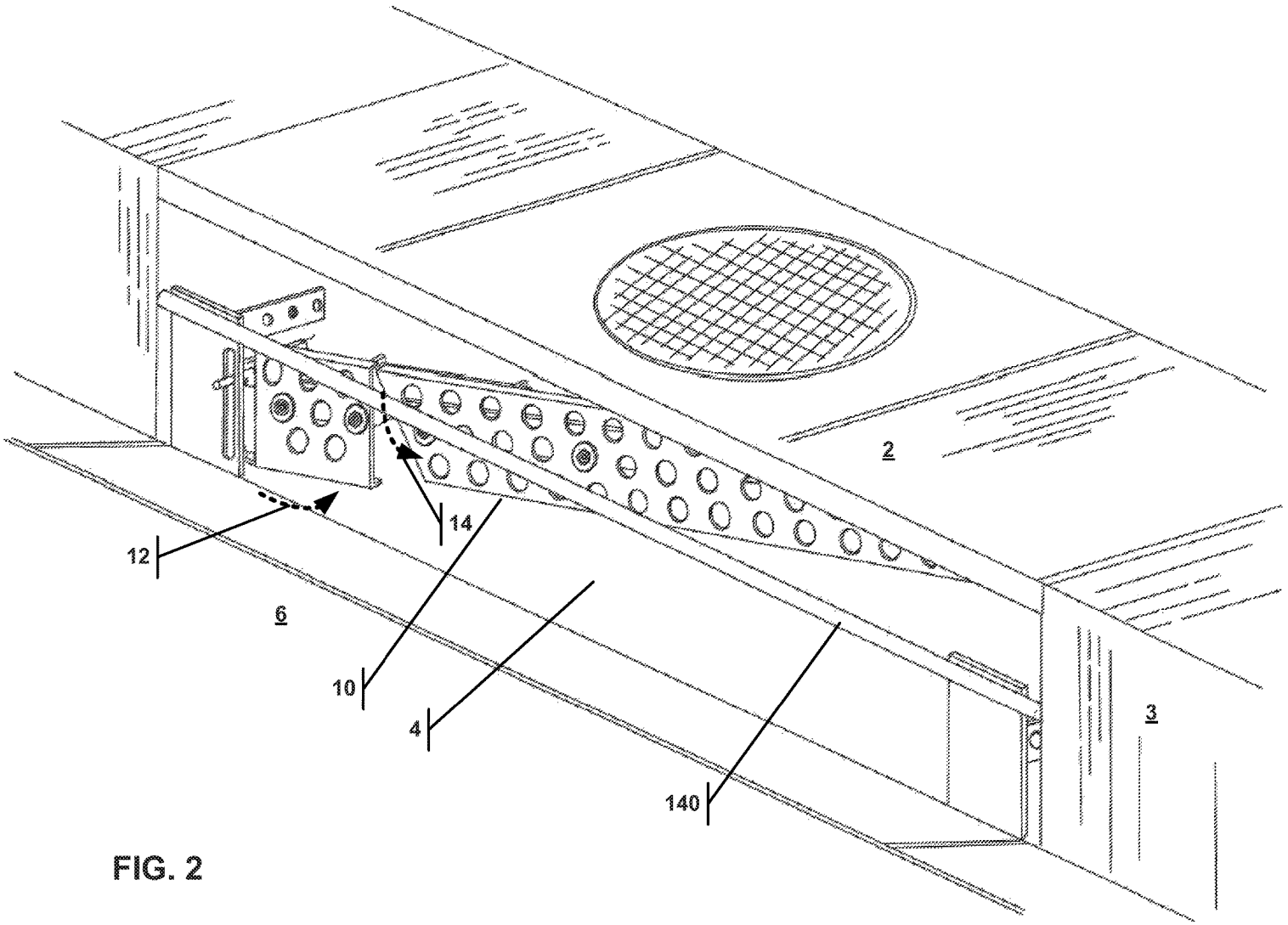
FIG. 2 is a perspective view of the retractable screen in the opened mode, with both the first portion and second portion rotated about their respective hinges.
Figure 5:
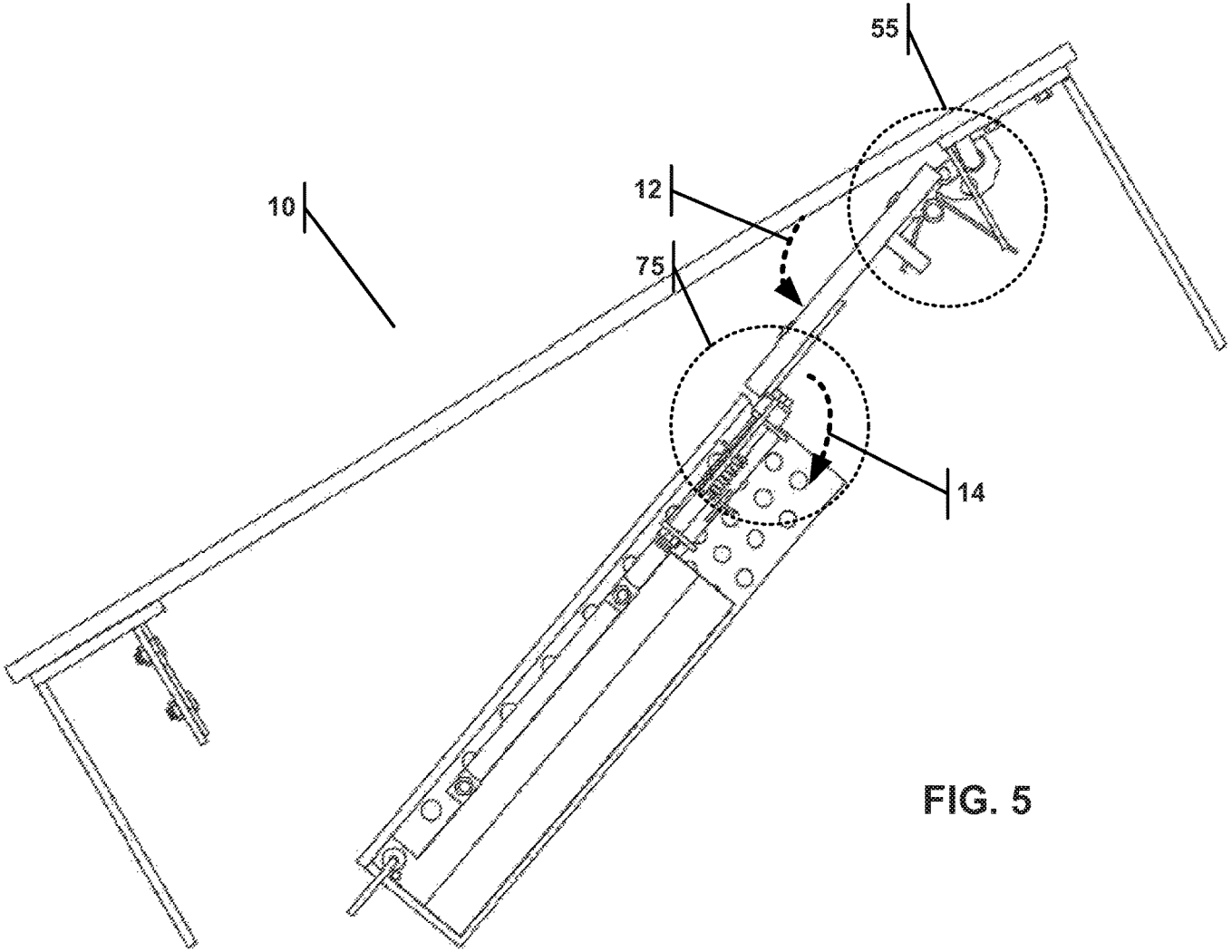
FIG. 5 is a top perspective view of the retractable screen in the open mode.

FIG. 2 shows the screen 10 in the open mode where the screen has rotated horizontally (shown by arrow 12) and vertically (shown by arrow 14). The horizontal rotation is substantially parallel to a horizontal plane, for example the plane defined by the street. The vertical rotation is orthogonal to the horizontal plane—i.e., substantially parallel to a vertical plane. While the absolute terms of "horizontal" and "vertical" are used throughout this disclosure, it would be apparent that when installed the screen 10 may not be precisely in such an orientation. For example, the curb wall 3 may not be vertical, such that the screen installed within the curb inlet 4 would not have a strictly "horizontal" or "vertical" rotation. What is apparent is that the dual action means that the screen can rotate about a first axis, and also rotate about a second axis that is substantially orthogonal to the first. FIG. 5 illustrates the dual action rotation (again one rotation is substantially orthogonal to the other). The amount of horizontal shown in FIG. 5 is about 25 degrees and vertical rotation is about 40 degrees (the vertical rotation is better seen in FIG. 6A). Preferably the screen opens at least 5 degrees about each hinge, and more preferably 10 degrees. The screen 10 may also have a child safety bar 140 that blocks large objects (including children) from entering the curb inlet 4, regardless of whether the screen is in the closed or open mode.

Figure 3:
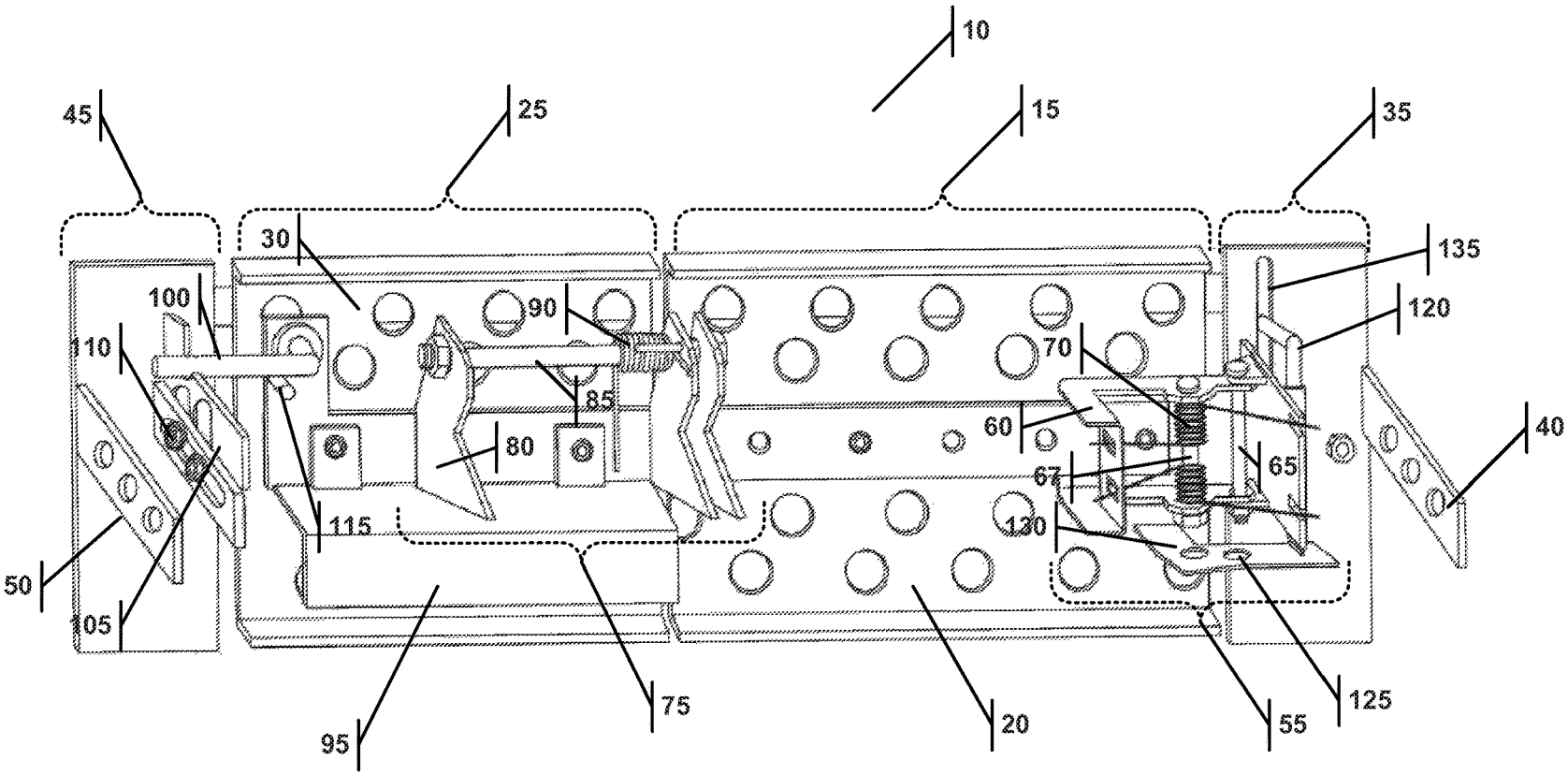
FIG. 3 is a rear perspective view of the retractable screen in the closed mode.
Figure 4:
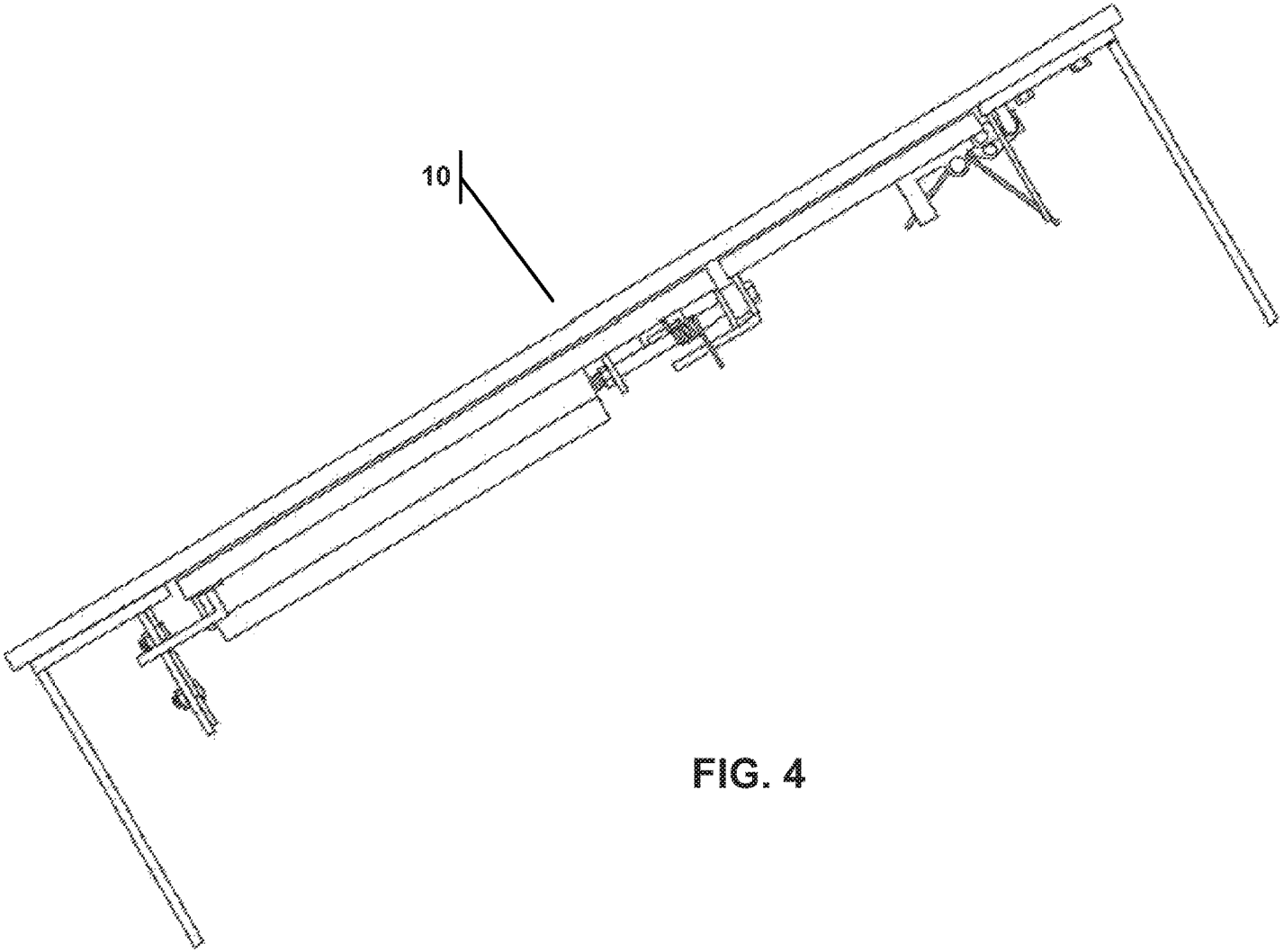
FIG. 4 is a top perspective view of the retractable screen in the closed mode.

FIG. 3 is a view of the screen from the inlet side (i.e., opposite from the street side shown in FIGS. 1 and 2). The dual action retractable screen 10 includes four main components: the first screen portion 15, the second screen portion 25, the hinge mount 35 and the latch mount 45. The first screen portion 15 includes a first screen portion perforated surface 20 that allows storm water to travel past the screen into the curb inlet 4 and ultimately the storm catch basin. The first screen portion 15 is connected to the hinge mount 35 via a horizontal hinge 55 that allows the first screen portion 15 to rotate within a substantially horizontal plane. The second screen portion 25 also has a second screen portion perforated surface 30 that permits water to pass through the screen. At the edge of the second screen portion 25 is a latch pin 100. A vertical hinge 75 connects the first screen portion 15 to the second screen portion 25, allowing the second screen portion 25 to rotate within a substantially vertical plane. The latch mount contains a latch saddle 105 that receives the latch pin 100. The hinge mount 35 includes a hinge mount bracket 40 that securely connects the screen 10 to the curb inlet 4. Likewise, the latch mount 45 has a latch mount bracket 50 to secure the screen 10 to the curb inlet 4. The horizontal hinge 55 may include a horizontal hinge spring 70 that biases the position of the first portion 15, as well as a horizontal hinge pin 65 and bracket 60. Similarly, the vertical hinge 75 may have a vertical hinge spring 90 that biases the position of the second portion 25 as well as a vertical hinge pin 85 and bracket 80. This biasing may be to maintain the screen 10 in the closed mode when the screen 10 is not experiencing a sufficient water force.

The screen operates in two modes: (1) a closed mode (shown in FIGS. 1, 3, 4, 6A, 6C, 6D, 8, 9, and 12) where the latch pin 100 is disposed of in the latch saddle 105, inhibiting rotation about the horizontal hinge; and (2) an open mode (shown in FIGS. 2, 5, 6A, and 13) where the latch pin is dislodged from the latch saddle, permitting rotation about the horizontal hinge and about the vertical hinge.

The screen may transition from the closed mode to the open mode when the second screen portion 25 rotates about the vertical hinge 75, causing the latch pin 100 to move away from the latch saddle 105. If the water force 97 is sufficiently strong to overcome the screen 10 inertia and spring biasing, the second portion 25 rotates vertically (shown by arrow 14) as shown in greater detail in FIG. 6A. The latch pin 100 is connected to the second screen portion 25, and therefore is in the same rotational frame, and also moves. This is shown by latch pin disengagement motion arrow 102. A water catch plate 95 may be used to provide the water force a larger area on which to force open the screen 10. Also, the length of the second screen portion 25 may be larger than the length of the first screen portion 15 (as shown in FIGS. 1 and 2) to provide a large surface on which the water force can act. FIGS. 1 and 2 show the second screen portion 25 has a length that is approximately five time longer than the first screen portion 15.

Figure 6A:
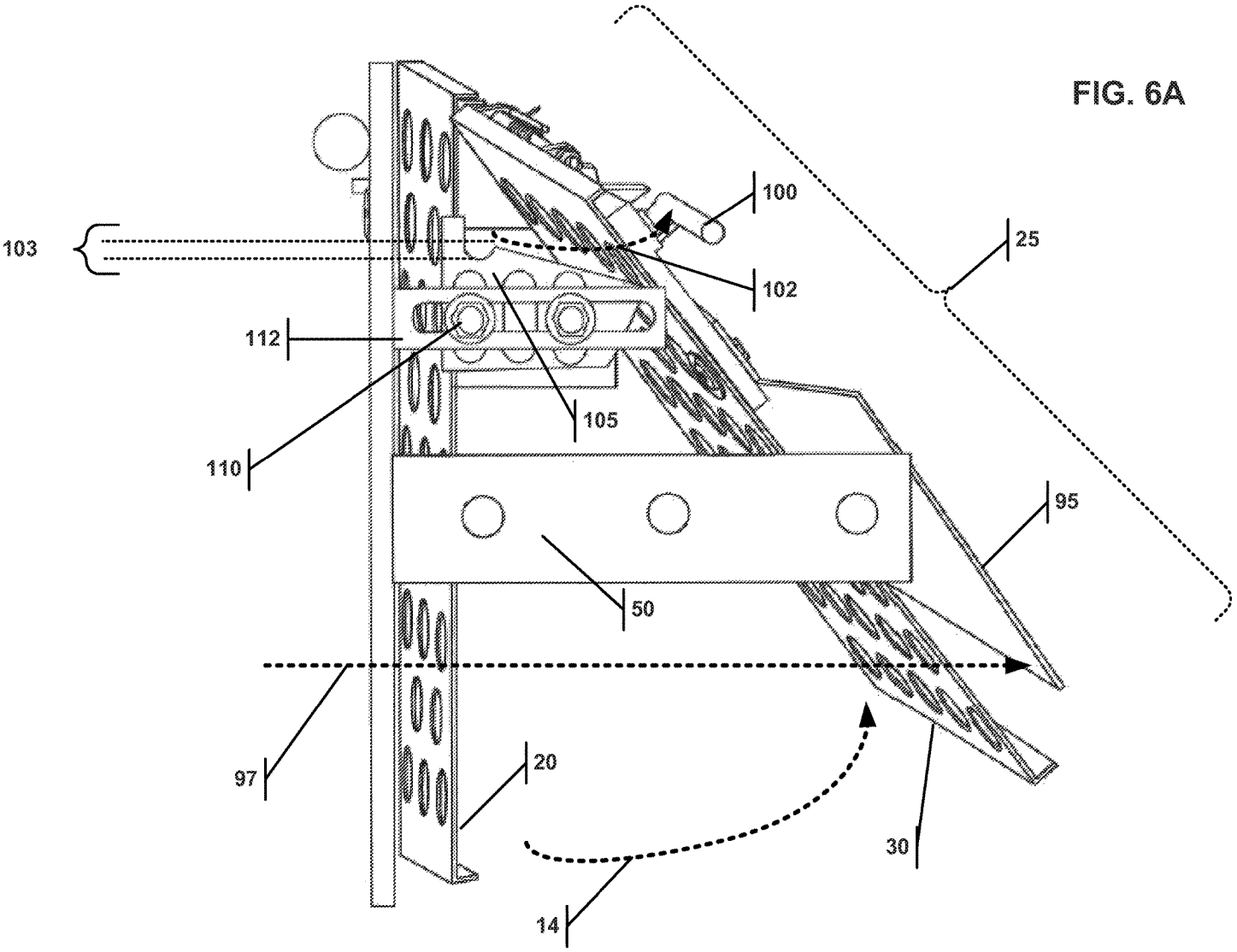
FIG. 6A is a right-side perspective view (i.e., from the latch mount perspective) of the retractable screen system in the open mode.
Figure 6C:
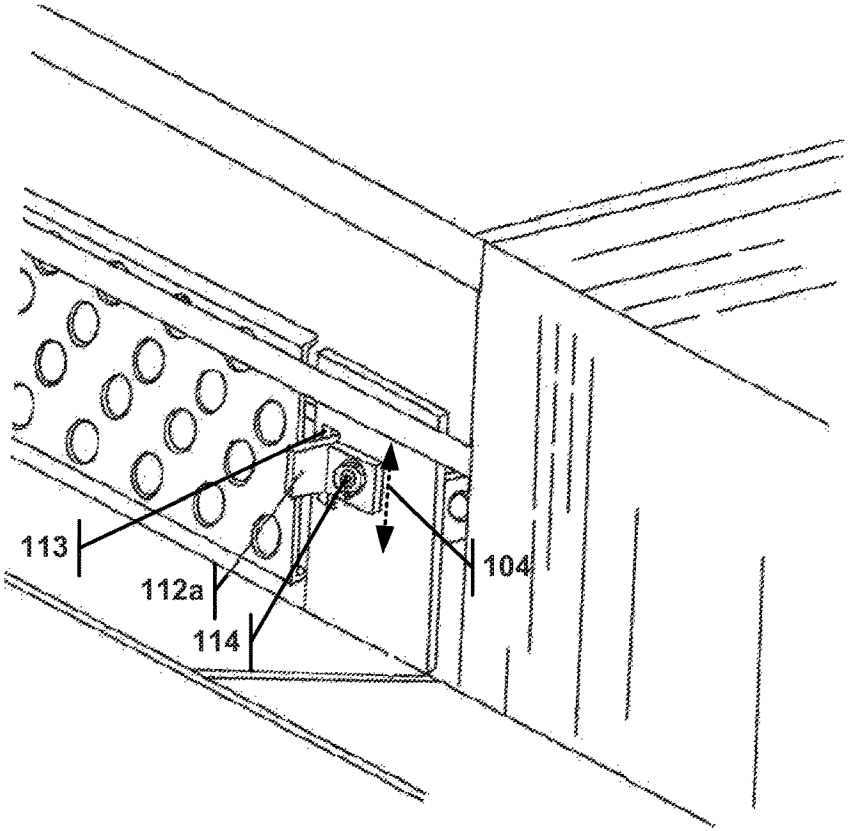
FIG. 6C is a street side perspective view of the alternative embodiment shown in FIG. 6B.
Figure 6B:
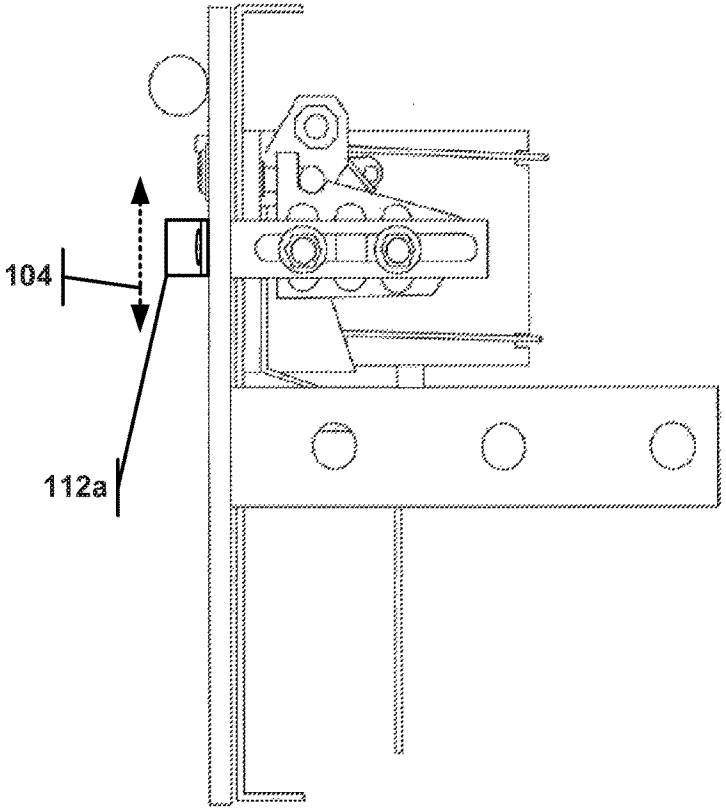
FIG. 6B is a right-side perspective view of an alternate embodiment of the retractable screen system in the open mode, where the pin saddle bracket is adjustable from the street side.
Figure 6D:
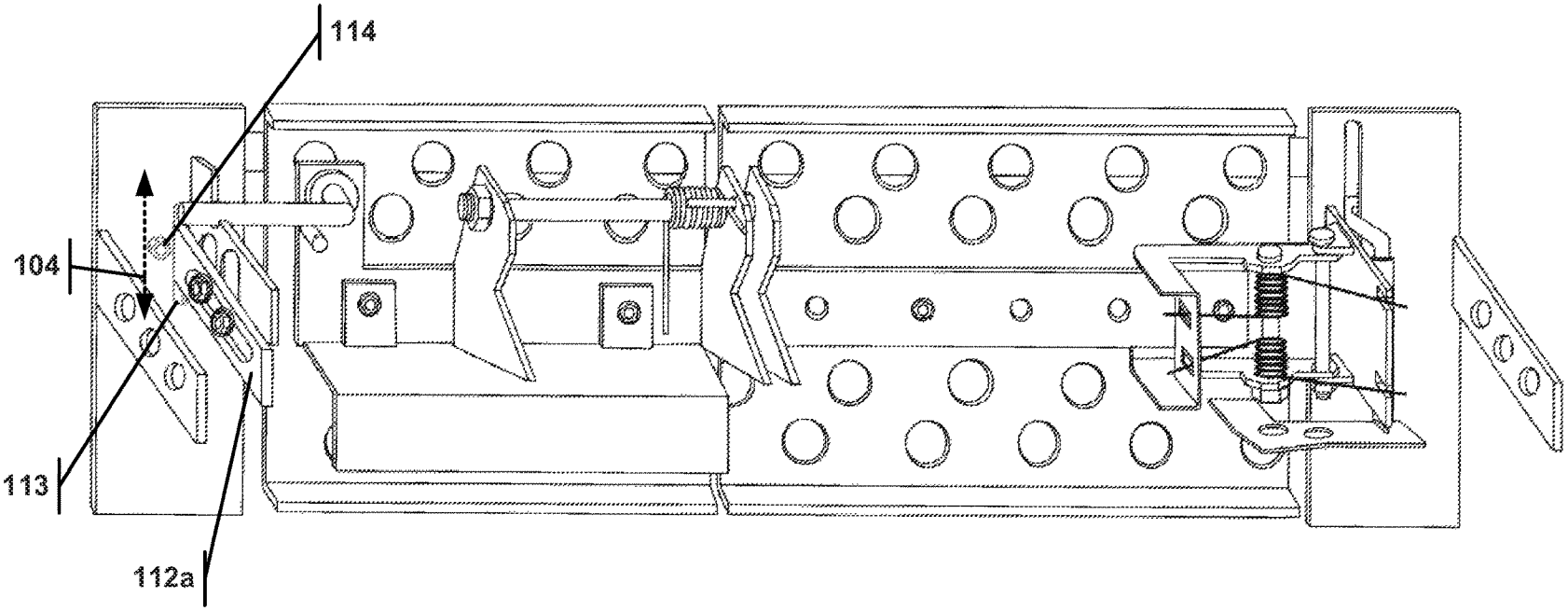
FIG. 6D is a rear perspective view of the alternative embodiment shown in FIG. 6B.
Figure 7:
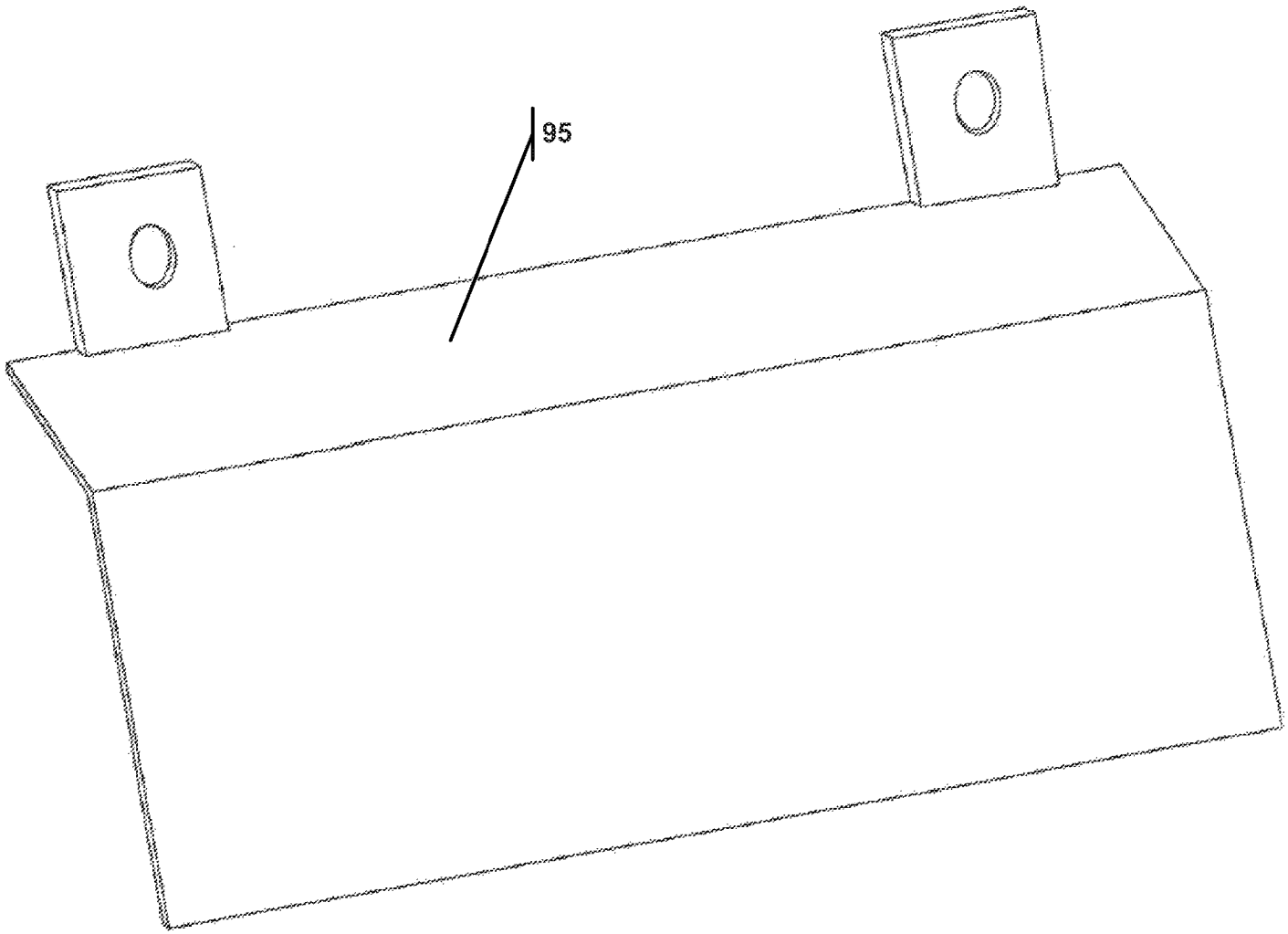
FIG. 7 is a back perspective view of the water-catch plate.

The amount of water force necessary to open the screen 10 may be adjusted. To transition from the closed to open mode, a minimum movement of the latch pin 103 may be necessary before the latch pin 100 dislodges from the latch saddle 105. This minimum movement 103 may be varied. For example, the latch saddle 105 position may be adjustable (see fasteners 110) and the minimum movement 103 is varied by changing the position of the latch saddle 105. As shown in more detail in FIGS. 6B and 6D, the latch saddle bracket 112*a* may extend to the street side, such that the minimum movement 103 can be varied from the street side of the curb inlet by change the position of the latch saddle bracket 112*a* as shown by arrow 104. FIG. 6C shows this embodiment from the curbside perspective. The latch saddle bracket 112*a* exits the front of the screen 10 through a latch saddle bracket slot 113, and the latch saddle bracket 112*a* may be fixed in a certain position by the latch saddle bracket fastener 114. Again, by changing the position of the latch saddle bracket 112*a*, the minimum movement 102 is varied, thus the force necessary to open the screen 10 can be adjusted. A common required pressure to unlock the screen is 2 PSI.

As another non-limiting example, a latch pin rest 115 (see FIG. 3) may be used, and the latch pin rest 115 position may be adjustable. The minimum movement 103 is therefore varied by changing the position of the latch pin rest 115.

Because the screen 10 is biased by springs 70 and 90, the force necessary to rotate the portions of the screen is proportional to the extent to which the spring is stretched (Hooke's law). Therefore, the amount of latch pin 100 movement is based on the magnitude of the water force. Thus, varying the minimum movement 103 varies the magnitude of water force necessary to transition the screen 10 from the closed mode to the open mode.

Figure 8:
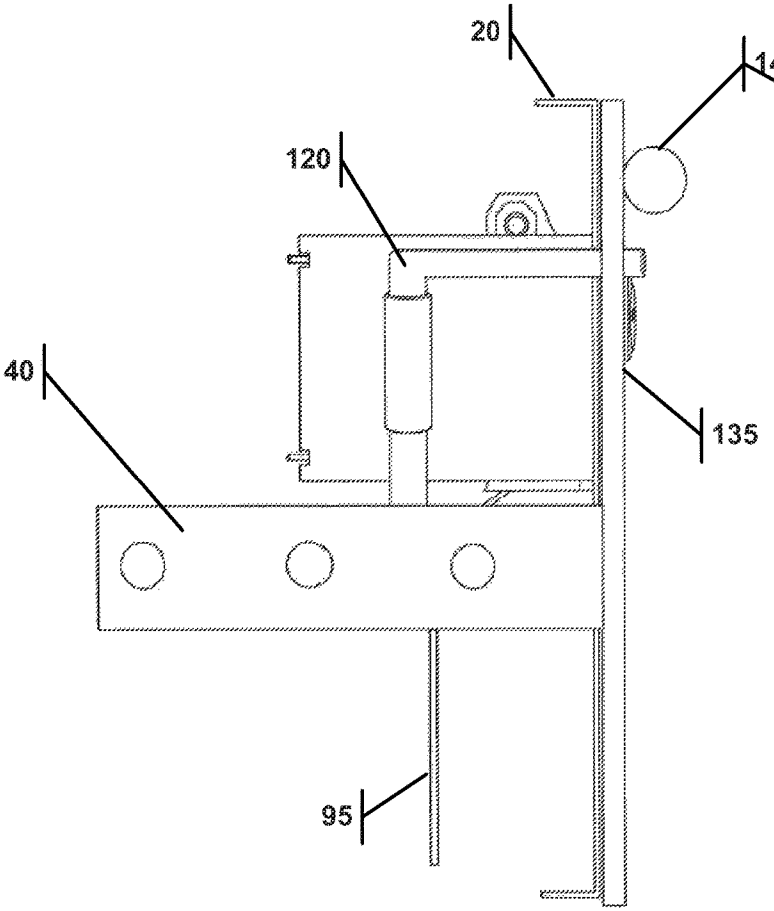
FIG. 8 is a left-side perspective view (i.e., from the hinge mount perspective) of the retractable screen in the closed mode.

FIG. 8 illustrates the screen 10 from the hinge mount 35 perspective, in the closed mode. The locking pin 120 can be used to maintain the screen 10 in a locked and open position. This is discussed below with reference to FIGS. 12 and 13.

Figure 9:
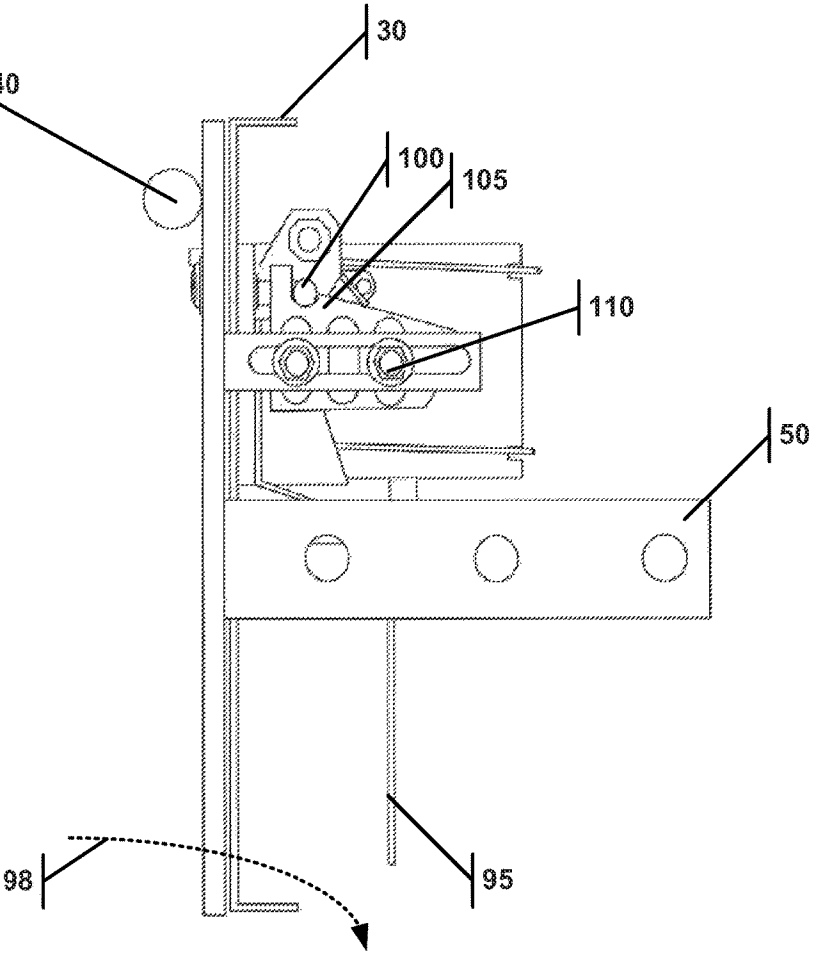
FIG. 9 is a right-side perspective view (i.e., from the latch mount perspective) of the retractable screen system in the closed mode.

FIG. 9 is a view of the screen from the latch mount 35 perspective in the closed mode. The latch pin 100 is engaged (i.e., sitting in) the latch pin saddle 105, preventing rotation about the horizontal hinge 55. In the closed mode, water can still flow through the screen and into the catch basin without impart a force on the water catch plate 95 (such a water flow is shown by arrow 98). However, when the water flow gets large enough it may then hit the water catch plate 95, and, if of sufficient force, cause the second screen portion 25 to rotate and thus transition the screen 10 into the open mode. It should also be noted that if the second screen perforated surface 30 becomes clogged with leaves and other debris, then the water force may act on this structure and may cause the vertical hinge rotation and transition of the screen 10 to the open mode.

Figure 10:
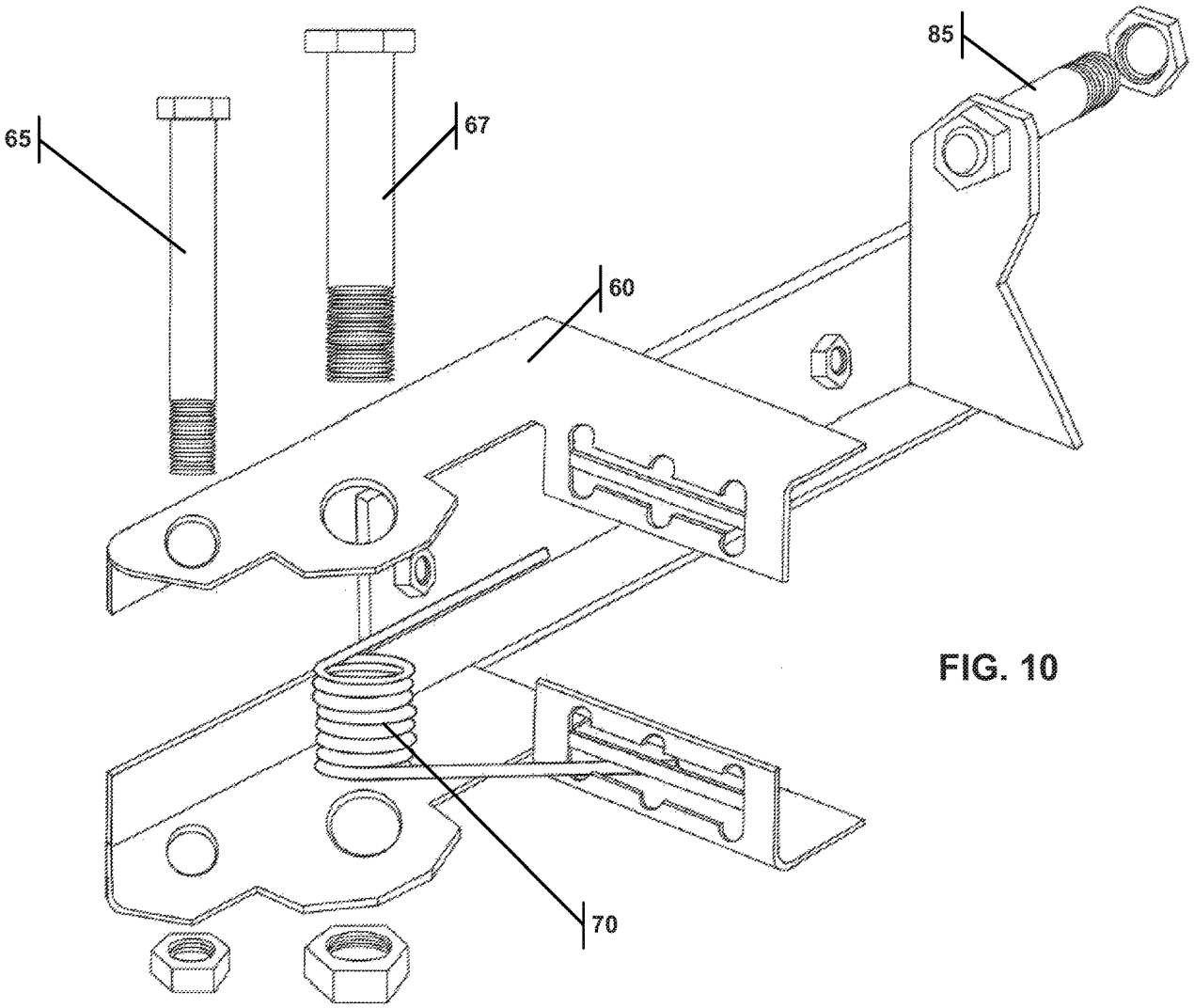
FIG. 10 is a close-up back perspective exploded view of the horizontal hinge.

FIG. 10 is an exploded view of the horizontal hinge 55, which may include a horizontal hinge bracket 60, a horizontal hinge pin 65 (about which rotations occurs), a horizontal hinge spring bolt 67 and a horizontal hinge spring 70 (that biases the screen 10 to the closed mode). The force exerted by the horizontal hinge spring 70 may be adjusted by changing the horizontal hinge spring force of the adjustment slot 72.

Figure 11:
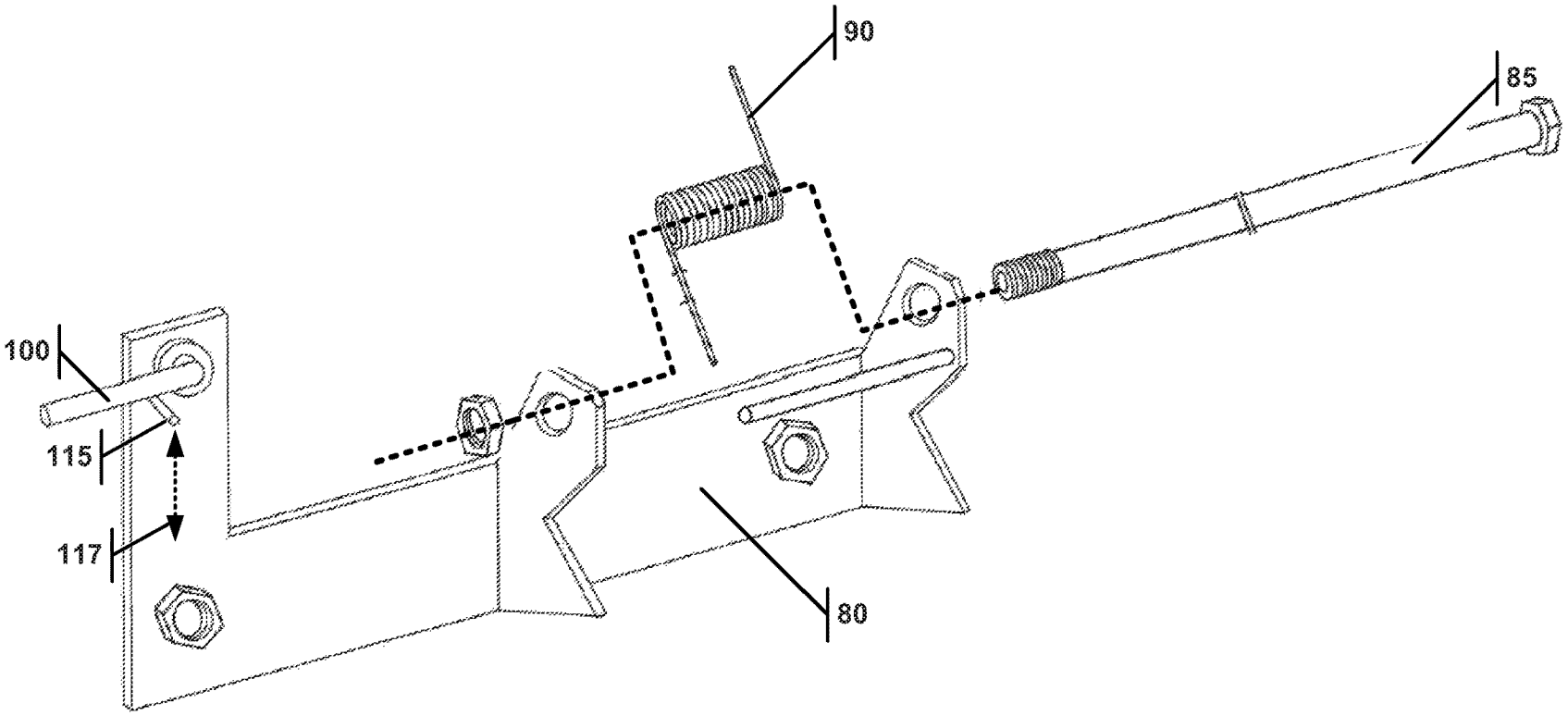
FIG. 11 is a close-up back perspective exploded view of the vertical hinge.

FIG. 11 is an exploded view of the vertical hinge 75, which may include a vertical hinge bracket 80, a vertical hinge pin 85 (about which rotations occurs), a vertical hinge spring 90 (that biases the screen 10 to the closed mode), and a latch pin rest 115. The rest 115 may be adjusted in the direction of arrow 117, thus adjusting the latch pin minimum movement distance for disengagement, thereby adjusting the amount of water force necessary to transition the screen 10 from the close to open mode. Again, the absolute orientations of "vertical" and "horizontal" are used because in the preferred embodiment, the screen 10 would be installed in the curb inlet 4 in this orientation. But curb inlet 4 may not be so oriented, such that the screen 10 installed therein would not have a strictly "horizontal" or "vertical" rotation. What is apparent is that the dual action means that the screen 10 can rotate about first hinge 55 axis, and also rotate about a second hinge 75 axis that is orthogonal to the first.

Figure 12:
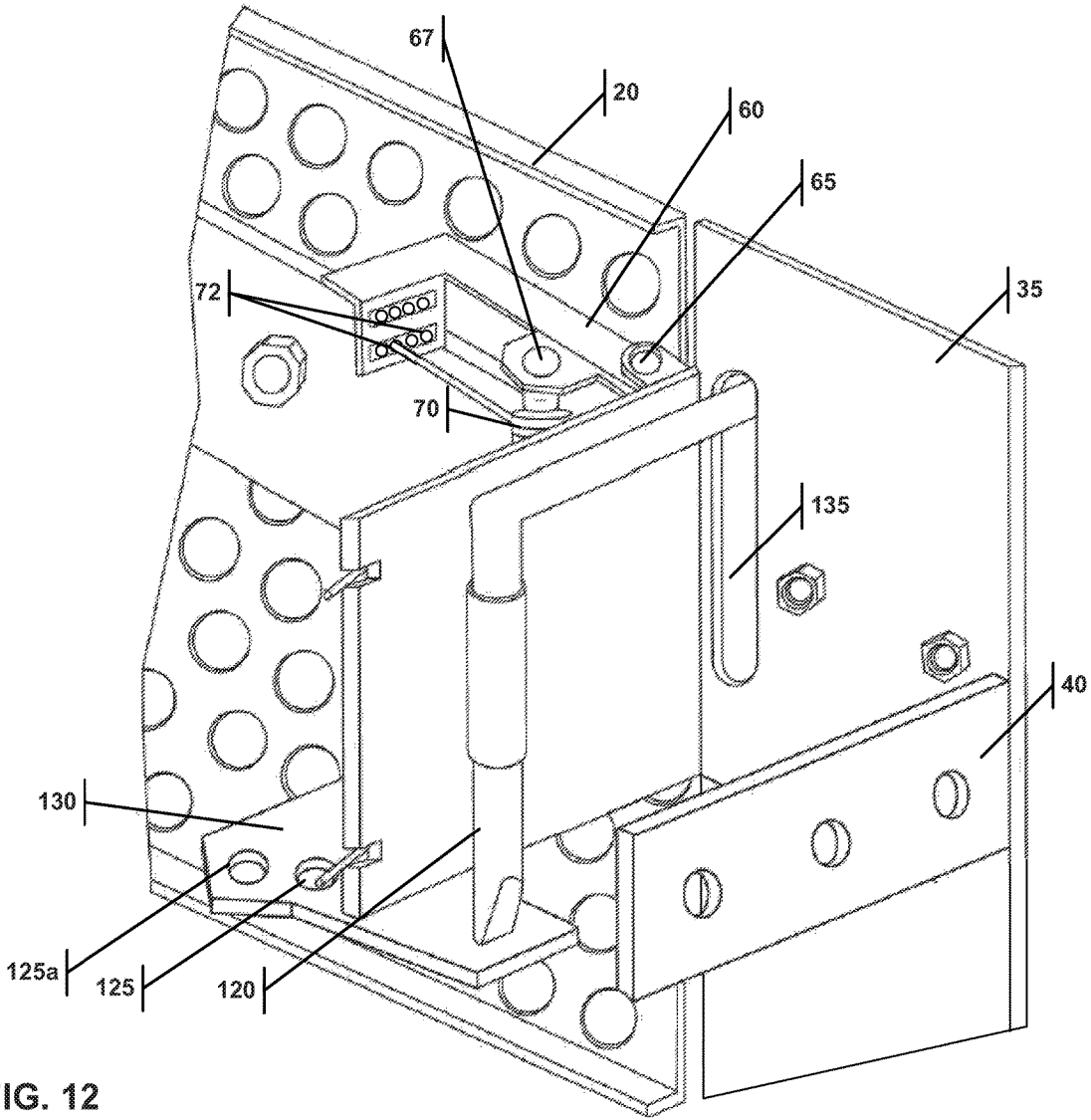
FIG. 12 is a close-up perspective view (i.e., from the hinge mount perspective) of the retractable screen in the closed mode.
Figure 13:
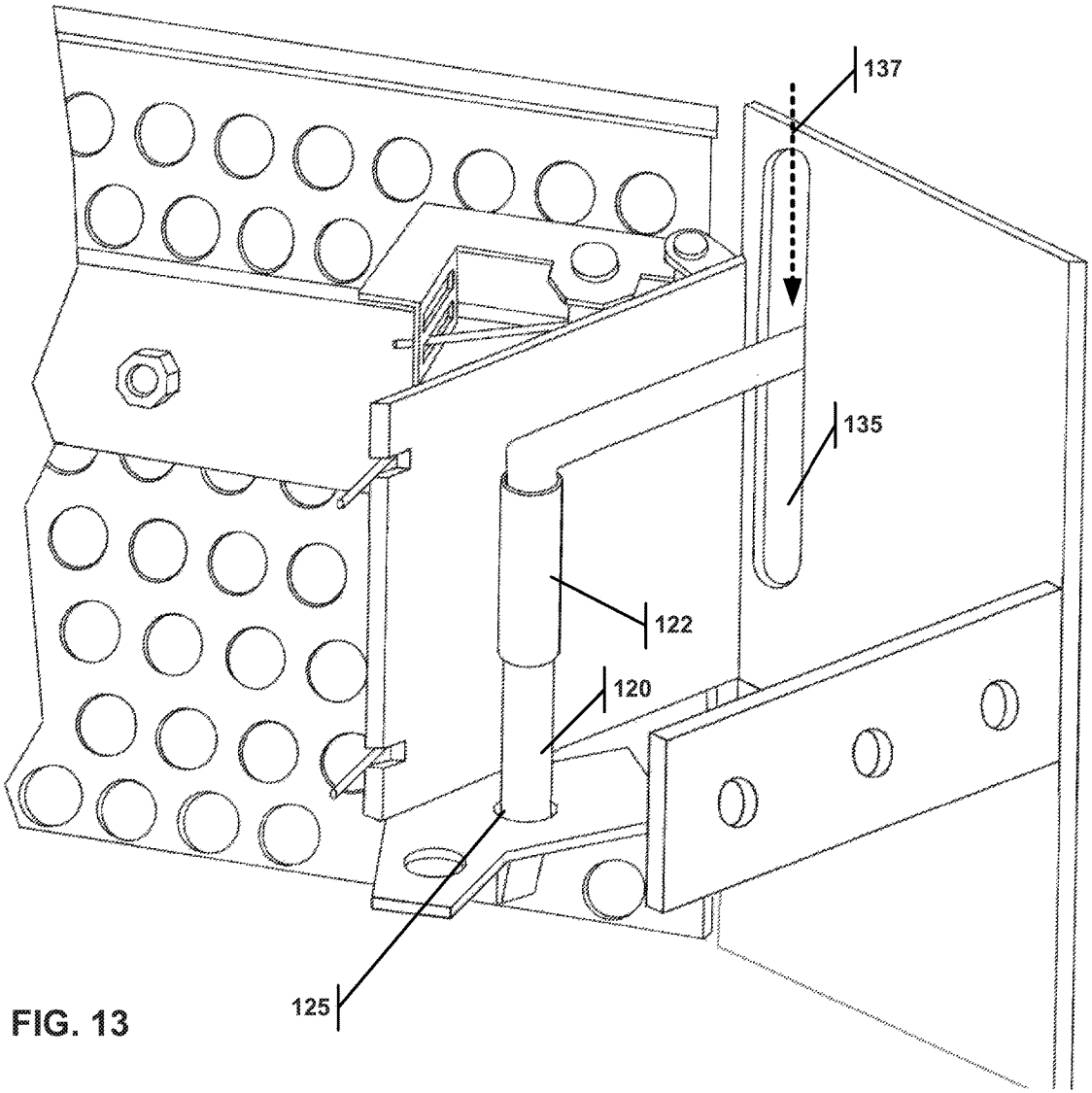
FIG. 13 is a close-up perspective view (i.e., from the hinge mount perspective) of the retractable screen in the open mode with the locking pin engaged.

FIGS. 12 and 13 illustrate the locking mechanism of the screen 10. To accommodate manually locking the screen 10 in the open position, possibly in anticipation of a high flood event, the screen 10 may include a locking pin hole 125 and a locking pin 120. The locking pin 120 is constructed to engage the locking pin hole 125 and when so engaged inhibits rotation about the horizontal hinge 55. FIG. 12 shows the screen 10 in the closed mode. While FIG. 12 shows that the locking pin 120 cannot engage the locking pin hole 125 in the closed mode, it would be apparent that additional locking pin hold(s) may be placed in the locking pin hole bracket 130 to allow for the locking of the screen in the closed mode. FIG. 13 shows the screen 10 in the open and locked mode. Rotation about the horizontal hinge 55 has moved the locking pin hole bracket 130 such that the locking pin hole 125 can now be engaged by the locking pin 120. This is done by sliding the locking pin 120 along the locking pin channel 135 in the direction of arrow 137, locking pin sleeve 122 and assuring that the locking pin 120 slides in a fixed direction. It should be noted that FIG. 13 illustrates a second locking pin hole 125*a*, which would allow engagement with the locking pin 120 when the screen 10 is opened to and even larger extent (i.e., the screen 10 is rotated about the horizontal hinge 55 to a larger degree). It would be apparent that several locking pin holes may be used to allow for various degrees of locked-openings for the screen 10.

Because the locking pin 120 emerges out to the street side of the screen 10, it may be accessible from the street side of the curb inlet 4, thus allowing engagement of the locking pin 120 from the street side of the curb inlet 4. Ultimately, engagement of the locking pin 120 into the locking pin hole 125 can maintain the screen locked in the open position.

The invention has been described in connection with specific embodiments that illustrate examples of the invention but do not limit its scope. Unless indicated otherwise, any feature, aspect or element of any of these example embodiments may be removed from, added to, combined with or modified by any other feature, aspect or element. As will be apparent to persons skilled in the art, modifications and adaptations to be above-described example embodiments of the invention can be made without departing from the spirit and scope of the invention, which is defined only by the following claims.

The invention claimed is:

1. A dual action retractable screen to be mounted to a curb inlet, the screen comprising:
- a hinge mount adapted to be attached to a curb inlet;
- a first screen portion comprising a first screen portion perforated surface;
- a horizontal hinge connecting the hinge mount to the first screen portion and adapted to allow the first screen portion to rotate within a substantially horizontal plane;
- a second screen portion comprising a second screen portion perforated surface and a latch pin;
- a vertical hinge connecting the first screen portion to the second screen portion and adapted to allow the second screen portion to rotate within a substantially vertical plane;
- a latch mount comprising a latch saddle adapted to receive the latch pin, the latch mount is adapted to be attached to the curb inlet;

wherein the screen comprises two modes:
- (1) a closed mode wherein the latch pin is disposed of in the latch saddle, inhibiting rotation about the horizontal hinge;
- (2) an open mode wherein the latch pin is dislodged from the latch saddle, permitting rotation about the horizontal hinge and about the vertical hinge.

2. The screen of claim 1, wherein the screen transitions from the close mode to the open mode when the second screen portion rotates about the vertical hinge.

3. The screen of claim 2, wherein the rotation causes the latch pin to move away from the latch saddle.

4. The screen of claim 2, wherein the second portion is adapted to receive a force from a stream of water entering the curb inlet, and upon receiving the water force the second screen portion rotates about the vertical hinge.

5. The screen of claim 4, wherein the second portion further comprises a water catch plate that receives the water force.

6. The screen of claim 1, further comprising a minimum movement of the latch pin before the latch pin dislodges from the latch saddle, wherein the minimum movement can be varied.

7. The screen of claim 6, wherein the latch saddle position is adjustable and the minimum movement is varied by changing the position of the latch saddle.

8. The screen of claim 6, further comprising a latch pin rest, wherein the latch pin rest position is adjustable and the minimum movement is varied by changing the position of the latch pin rest.

9. The screen of claim 8, wherein the latch pin rest position can be varied from the street side of the curb inlet.

10. The screen of claim 6, wherein the second portion is adapted to receive a force from a stream of water entering the curb inlet, and upon receiving the water force the latch pin moves away from the latch saddle, wherein the amount of latch pin movement is based on the magnitude of the water force, and varying the minimum movement varies the magnitude of water force necessary to transition the screen from the close mode to the open mode.

11. The screen of claim 1, further comprising a locking pin hole and a locking pin, the locking pin constructed to engage the locking pin hole and when so engaged inhibits rotation about the horizontal hinge.

12. The screen of claim 11, further comprising a plurality of locking pin holes.

13. The screen of claim 11, wherein the locking pin moves vertically to engage the locking pin.

14. The screen of claim 11, wherein the locking pin is accessible from the street side of the curb inlet.

15. The screen of claim 1, wherein the horizontal hinge comprises a horizontal hinge spring that biases the position of the first portion.

16. The screen of claim 1, wherein the vertical hinge comprises a vertical hinge spring that biases the position of the second portion.

17. The screen of claim 1 comprising a child safety bar.

18. The screen of claim 1, wherein the first portion has a first length and the second portion has a second length, wherein the second length is at least twice as long as the first length.

19. The screen of claim 1, wherein the horizontal hinge allows a rotation of the first portion of at least 5 degrees and wherein the vertical hinge allows a rotation of the second portion of at least 5 degrees.

20. A dual action retractable screen to be mounted to a curb inlet, the screen comprising:
- a hinge mount adapted to be attached to a curb inlet;
- a first screen portion comprising a first screen portion perforated surface;
- a first hinge connecting the hinge mount to the first screen portion and adapted to allow the first screen portion to rotate within a first plane;
- a second screen portion comprising a second screen portion perforated surface and a latch pin;
- a second hinge connecting the first screen portion to the second screen portion and adapted to allow the second screen portion to rotate within a second plane that is substantially orthogonal to the first plane;
- a latch mount comprising a latch saddle adapted to receive the latch pin, the latch mount is adapted to be attached to the curb inlet;

wherein the screen comprises two modes:
- (3) a closed mode wherein the latch pin is disposed of in the latch saddle, inhibiting rotation about the first plane;
- (4) an open mode wherein the latch pin is dislodged from the latch saddle, permitting rotation about the first and second planes.

* * * * *